US007108339B2

(12) United States Patent
Berger

(10) Patent No.: US 7,108,339 B2
(45) Date of Patent: Sep. 19, 2006

(54) SELF-CLOSING DRAWER GUIDES WITH INTEGRATED DAMPING

(75) Inventor: Horst Berger, Bielefeld (DE)

(73) Assignee: Alfit AG, Gotzis (AT)

( * ) Notice: Subject to any disclaimer, the term of this patent is extended or adjusted under 35 U.S.C. 154(b) by 0 days.

(21) Appl. No.: 10/509,287

(22) PCT Filed: Mar. 21, 2003

(86) PCT No.: PCT/EP03/02960

§ 371 (c)(1),
(2), (4) Date: Sep. 23, 2004

(87) PCT Pub. No.: WO03/079855

PCT Pub. Date: Oct. 2, 2003

(65) Prior Publication Data

US 2005/0116593 A1 Jun. 2, 2005

(30) Foreign Application Priority Data

Mar. 26, 2002 (DE) ..... 202 04 860 U

(51) Int. Cl.
*A47B 88/04* (2006.01)

(52) U.S. Cl. ..... 312/333; 312/319.1

(58) Field of Classification Search ..... 312/330.1, 312/333, 334.1, 334.6, 334.7, 334.8, 334.44, 312/319.1
See application file for complete search history.

(56) References Cited

U.S. PATENT DOCUMENTS 3,539,240 A 11/1970 Delorenzo
5,302,016 A * 4/1994 Lautenschlager et al. ... 312/333
5,364,179 A 11/1994 Brüstle et al.
6,340,078 B1 * 1/2002 Scheible ..... 188/166
2002/0011766 A1 * 1/2002 Kim et al. ..... 312/319.1

FOREIGN PATENT DOCUMENTS

DE 43 28 502 A 3/1994
DE 19835466 * 2/2000
EP 1 188 397 A 3/2002

* cited by examiner

*Primary Examiner*—James O. Hansen
(74) *Attorney, Agent, or Firm*—Norris McLaughlin & Marcus PA; Christa Hildebrand

(57) ABSTRACT

A self-closing drawer guide includes a spring assembly with a piston disposed in an elongated cylindrical housing, with a piston rod attached to the piston and protruding from one end of the cylindrical housing. The spring assembly applies a force, when the drawer is being closed and when the drawer approaches the closed position, and holds the drawer in the closed position under pretension. The spring of the spring assembly that pretensions a ratchet element of the self-closing mechanism via the piston rod is arranged between the piston and one of the end walls that at least partially closes the end face of the cylindrical housing, whereby the housing of the spring assembly is fixedly arranged on the rail of the guide that supports the movable ratchet element.

7 Claims, 5 Drawing Sheets

SELF-CLOSING DRAWER GUIDES WITH INTEGRATED DAMPING

BACKGROUND OF THE INVENTION

The invention relates to drawer guide with a self-closing mechanism, with a guide rail to be attached to a body wall of an item of furniture, and a running rail that is movably supported relative to the guide rail and attached to the drawer, optionally with an interposed center rail. A movable ratchet element is disposed in a ratchet housing arranged on one of the two aforementioned outer rails and pretensioned in two end positions that are spaced apart in the movement direction of the drawers. The ratchet element has a receptacle for a catch, which enters the receptacle when the rails move relative to each other to approach the closed position, thereby disengaging the pretensioned movable ratchet element from the corresponding end position and moving the ratchet element by spring tension into the other end position. The ratchet element entrains the corresponding rail in the closing direction of the drawer by the catch held in the receptacle.

Self-closing drawer guides of this type (DE 4 020 277 C2) have been more frequently employed over the past years. Such drawer guides forcibly secure a pull-out drawer held in a cabinet body through the tension force of a pretensioned spring in the closing position, while the drawer is still being closed, but before reaching the fully closed position, and prevent accidental opening, which could occur, for example, when the drawer stop contacts the cabinet body or when air is displaced in the cabinet body, for example, when adjacent drawers are opened and closed. Because modern drawer guides tend to slide easily due to support of the rails by roller bodies or rollers, the pretensioning springs used for closing the drawer have to be sized so that the corresponding drawers can safely close even when they are heavily loaded and, on the other hand, more lightly loaded drawers are not accidentally opened by air currents in the cabinet body. It has been observed that a spring with a pretension that optimally satisfies all these requirements is difficult to design. Typically, the tension force of the spring is therefore designed with a safety margin, which causes at least lighter drawers to close more quickly and hit the cabinet body, if a person operating the drawer does not intentionally slow down the closing motion. Many buyers of furniture object to this erratic closure, prompting the furniture manufacturers during the past years to make changes by including additional damping devices that are effective between the drawer and the cabinet body during the automatic drawer closure. These damping devices can prevent an excessive acceleration of the drawer when the spring tension of the self-closing mechanism is too high. However, the use of these additional damping devices represents an additional expense in the construction and assembly of the drawers. In addition, the damping devices are at least partially visible when the drawers are open, which is visually objectionable and poses the additional risk that objects placed in the drawers can get caught in these devices.

BRIEF SUMMARY OR THE INVENTION

It is therefore an object of the invention to provide a drawer guide with a self-closing mechanism that satisfies all requirements with respect to the closing force and the holding force when the drawer is closed, without disadvantageously requiring the precautionary selection of a large closing force which could cause an excessive acceleration of the drawer during closure.

Based on a drawer guide with a self-closing mechanism of the aforedescribed type, the object is solved by the invention in that that the spring assembly includes a piston disposed in an elongated cylindrical housing with a piston rod that is attached to the piston and projects outwardly from one end of the cylindrical housing, that the spring of the spring assembly that pretensions the movable ratchet element via the piston rod is arranged between the piston and one of the end walls that at least partially close off the end face of the cylindrical housing, and that the housing of the spring assembly is fixedly arranged on the rail that supports the movable ratchet element. According to the invention, a piston damper operating with air or with another damping fluid is used which includes the spring providing the pretension of the self-closing mechanism and can thereby be integrated in the self-closing mechanism.

According to a preferred embodiment of the invention, the end of the ratchet housing facing the piston rod that operates the ratchet element is provided with an elongated extension, which supports the cylindrical housing receiving the pretensioned spring.

The ratchet housing and the extension that supports the cylindrical housing advantageously form an elongated rail-like integral component, which can be manufactured, for example, by injection molding as an integrated plastic component.

The self-closing drawer guide can be designed to provide a full drawer extension, in which case a center rail can be disposed between the running rail and the guide rail and supported for longitudinal movement relative to these rails. The center rail supports the running rail and the guide rail with a vertical mutual spacing therebetween. The ratchet housing and the spring assembly can advantageously be arranged in the intermediate space between the running rail and the guide rail. The self-closing mechanism with integrated damping is hence completely obscured from view in the drawer guide and is also essentially protected from failure due to its location between the rails, for example by reducing the risk that objects located in a drawer below can be caught in the mechanism.

Advantageously, the ratchet housing that movably supports the ratchet element can be arranged on the running rail, while the catch can be arranged on the guide rail. The operation of the drawer guide can be easily checked even when the drawer is removed from the cabinet body.

BRIEF DESCRIPTION OF THE DRAWINGS

The invention will be described in more detail in the following description of an exemplary embodiment with reference to the drawing, which shows in FIG. 1 a cross-sectional view through a drawer sidewall formed as a double wall frame, which is movably supported in a cabinet body by drawer guides implemented according to the invention.

DETAILED DESCRIPTION OF THE INVENTION

Figure 1:
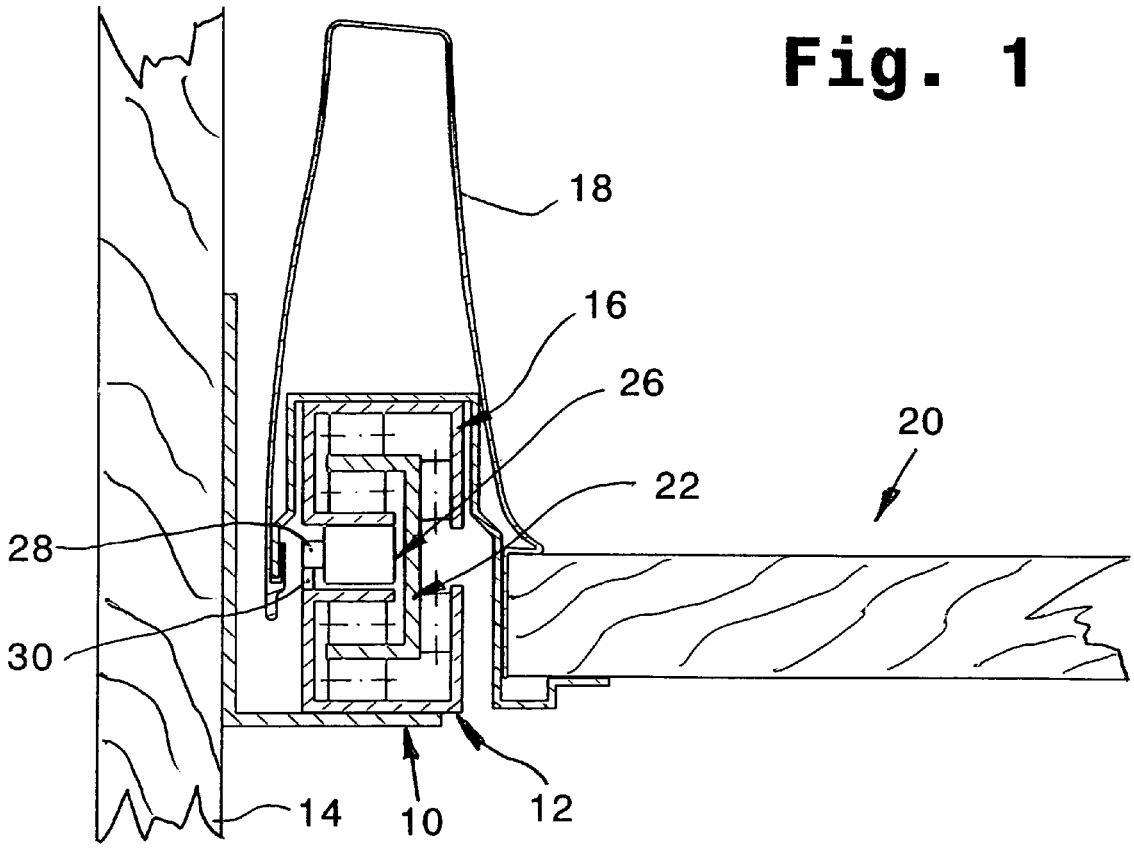

FIG. 1 shows a cross-sectional view perpendicular to the opening direction of a drawer guide labeled with reference numeral 10, which shows the arrangement of the guide rail 12 on the corresponding cabinet support wall 14 and the arrangement of the running rail 16 in the open bottom side of a drawer sidewall frame 18 of the drawer 20 that is implemented as a closed metallic hollow profile. In this particular embodiment, the drawer guide 10 is implemented as a fully opening guide, i.e., a center rail 22 which is formed by a metal profile having a U-shaped cross-sectional is arranged between the guide rail 12 and the running rail 16. The leg of the metal profile that extends from the connecting web at a right angle and is guided into the interior of the guide rail 12 or the running rail 16, is guided and supported in the depicted embodiment for longitudinal movement relative to the associated rail by roller bodies, such as caged rollers. Since this implementation of drawer guides is conventional and the invention is not limited to the depicted specific embodiment of drawer guides, the drawer guide 10 will not be described hereafter in detail.

According to one significant feature, the housing of a self-closing mechanism 26, depicted in the drawing as a square, is arranged in the intermediate space formed by the center rail 22 that is interposed between the guide rail 12 and the running rail 16. The operation of the ratchet element 28 that protrudes from the vertical boundary side of the mechanism 26 shown on the left of FIG. 1 is similar to that of the ratchet element described in DE 40 20 277 C2, which is pivotally supported for longitudinal displacement in the corresponding housing of the aforementioned self-closing mechanism and cooperates with a catch 30 protruding from the guide rail 12 into the intermediate space. The self-closing mechanism 26 is secured to the bottom side of the running rail 16, as will be seen in more detail from the following description in conjunction with FIG. 2.

Figure 2:
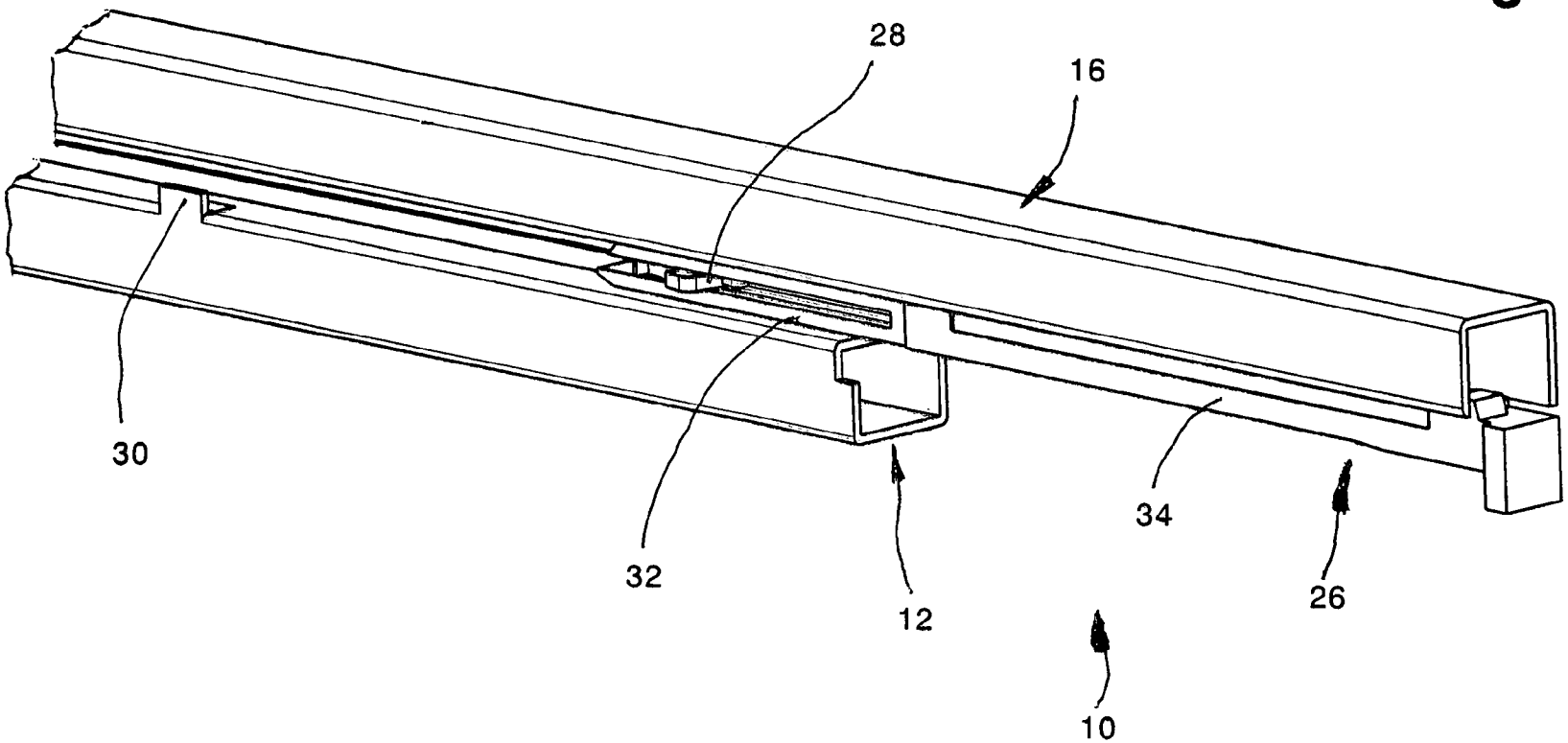
FIG. 2 a perspective view of the drawer guide used for supporting the drawer in the cabinet body according to FIG. 1, whereby the ends of the running and guide rail facing the cabinet interior are broken away.
Figure 3:
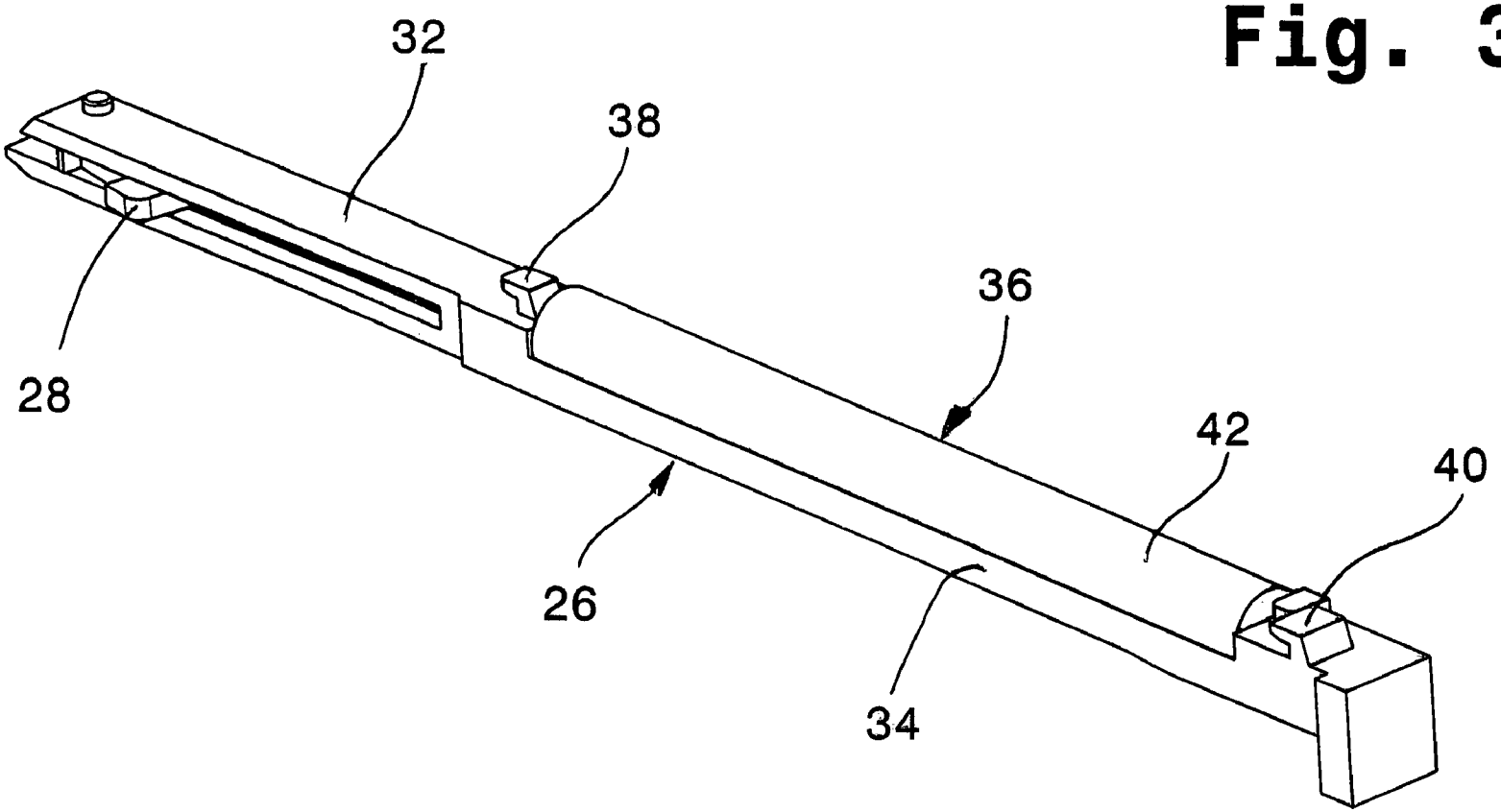
FIG. 3 a perspective view of the self-closing mechanism with integrated damping used in the drawer guides of FIG. 2.
Figure 4:
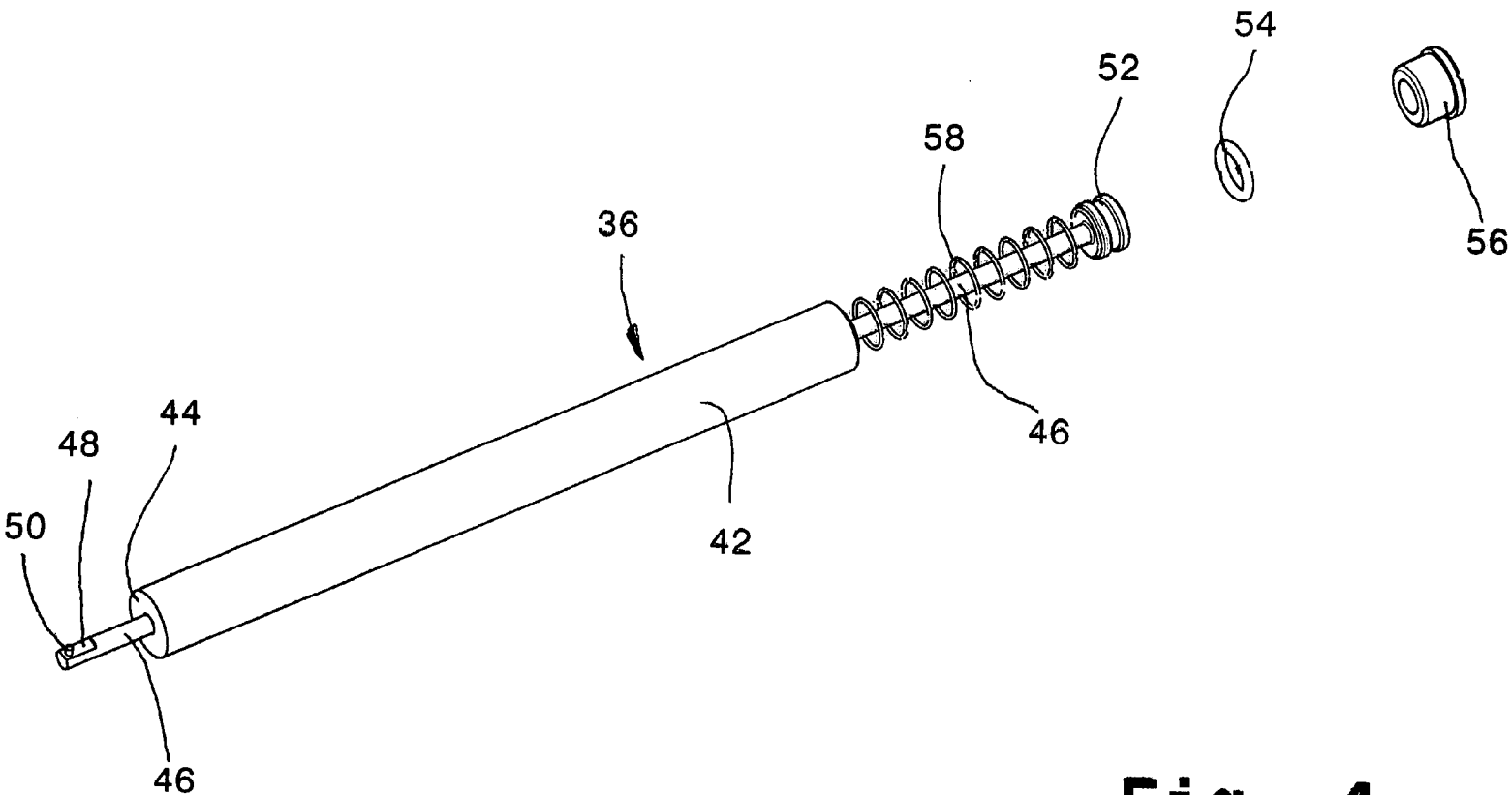
FIG. 4 a perspective view of the damper of the self-closing mechanism of FIG. 3 operating with a piston damper using air as a damping medium, wherein the end cap that in the assembled state encloses the piston, which is pretensioned by a coil compression spring, inside the corresponding cylindrical housing, and a sealing ring provided on the piston are shown in a disassembled state and removed from the housing.
Figure 5:
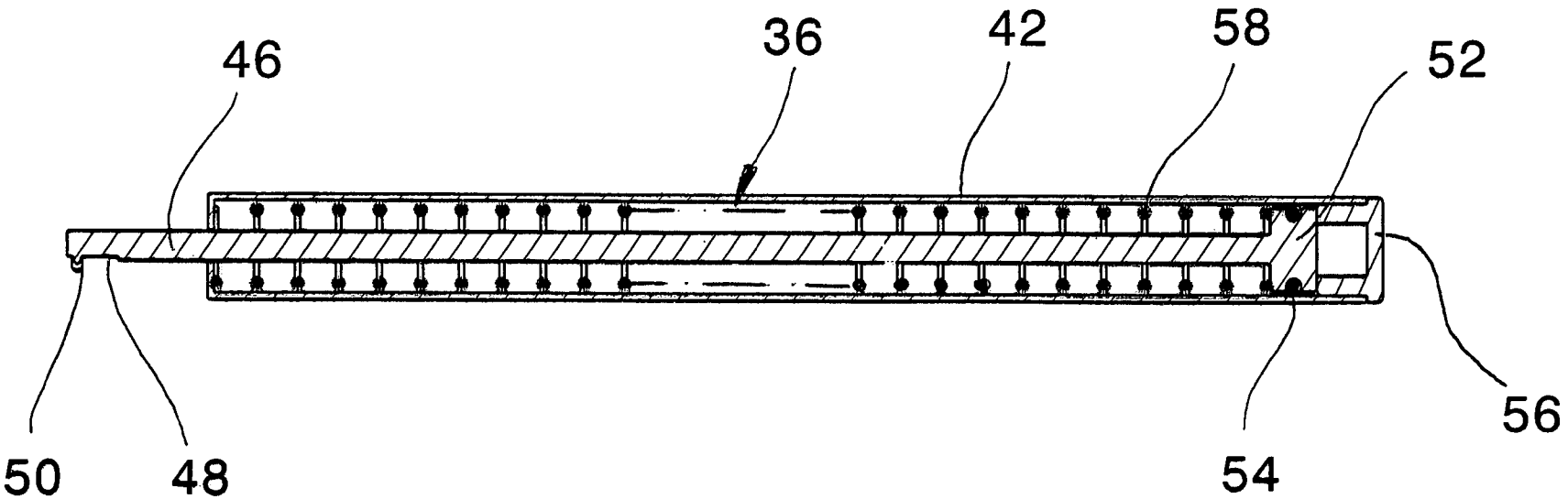
FIG. 5 in a longitudinal cross-sectional view the piston damper depicted in FIG. 4 in an assembled state.

The elongated rail-like housing includes a partial segment designated in FIGS. 2 and 3, which can be viewed as the actual ratchet housing 32, to which an elongated extension 34 is integrally attached, which receives in an elongated upper recess a piston damper 36 shown separately in FIGS. 4 and 5. The piston damper 36 will be described hereinafter in more detail in conjunction with FIGS. 4 and 5.

As seen in FIG. 3, hook-like projections 38 and 40 protrudes from the upwardly pointing flat side of the housing of the self-closing mechanism 26 which enable installation of the housing on the bottom side of the running rail 16, optionally by using additional suitable connecting means.

The piston damper 36 has an elongated cylindrical housing 42, with the free end of the piston rod 46 projecting from the end wall 44 of the housing 42 facing the ratchet housing 32. The end of the piston rod 46 can be coupled with the ratchet element 28 through a pin 50 protruding from a flat surface 48. The opposing end of the piston rod located in the interior of the cylindrical housing 42 includes a piston 52 that is movably placed in the housing 42 and includes an O-ring 54 in a circumferential angular groove. The piston 52 and the O-ring 54 are dimensioned relative to the unobstructed inside diameter of the housing 42 so as to form chambers in the interior of the housing 42 that is sealed by a housing plug 56 on opposing sides of the piston 52. Enclosed air can only flow from one chamber to the other chamber by strong throttling. Although the air flow from one chamber to the other chamber is throttled in the cylinder, the piston 52 can still be moved in the cylinder by the end of the piston rod 46 coupled to the ratchet element 28. However, the displacement velocity is severely limited by throttling of the air flowing from the chamber that decreases in volume to the chamber that increases in volume.

A compressed coil spring 58 is inserted in the interior of the housing between the end wall 44 of the housing 42 that faces the ratchet housing and is penetrated by the free end of the piston rod 40 and the piston 52. The piston 52 is pretensioned in the direction of the plug 56 that closes the cylindrical housing 42 by the pretension of spring 58. The piston 52 can be moved in the direction towards the ratchet housing 32 by pulling the free end of the piston rod 46 away from the end wall 44, whereby the already compressed spring 58 is compressed further, thereby increasing the spring tension. The spring 58 that is inserted in the damper 36 and invisible from the outside operates as a tension spring that moves the ratchet element 28, after being pivoted about the catch 30, into the partially relaxed end position when the running rail 16 is inserted in the closing direction. The corresponding drawer is then pulled into the interior of the cabinet body, while the closing speed is significantly reduced by the aforementioned throttling effect due caused by the air flowing from one chamber into the other chamber of the damper 36. An adverse effect on the closing function by spring turns getting caught on external components is eliminated by enclosing the spring 58 in the cylindrical housing 42. The return spring 58 can also facilitate disassembly of the piston 52 and the piston rod from the housing 42 after the plug 56 has been removed.

A more detailed description of the self-closing mechanism limited to the region of the ratchet housing 32, which includes pivoting and longitudinal displacement of the ratchet element 28 between two bistable end positions, is unnecessary within the context of the present application, because this function is known in the art, for example, from the aforementioned DE 40 20 277 C2.

As can be seen, modifications and improvements of the aforedescribed embodiment can be realized within the scope of the present invention. For example, the self-closing mechanism 26 can also be arranged on the guide rail 12 that is fixedly connected with the cabinet body, and the catch 30 accordingly can be disposed of the running rail 16, which may, of course, change the relative motion direction due to the change in the mechanism.

The invention claimed is:

1. A self-closing drawer guide comprising a guide rail for attachment to a body wall of an item of furniture;

a running rail for attachment to a furniture drawer, the running rail being movably supported relative to the guide rail;

a ratchet housing arranged on the running rail;

a movable ratchet element residing in the ratchet housing, the ratchet element is pretensioned in first and second positions that are spaced apart in a relative movement direction of the guide rail and running rail, the ratchet element comprising a receptacle adapted to receive a catch when the running rail moves relative to the guide rail and approaches a closed position, thereby disengaging the pretensioned movable ratchet element from the corresponding first position and moving the ratchet element by spring tension into the second position, the ratchet element entraining the running rail by the catch held in the receptacle in the closing direction of the drawer; and a cylindrical housing fixedly arranged to the ratchet housing, the cylindrical housing comprising a spring assembly comprising a piston and a spring, the piston having a piston rod projecting outwardly from one end of the cylindrical housing, and the spring being arranged between the piston and an end wall that at least partially closes off an end face of the cylindrical housing, and the spring being adapted to pretension the movable ratchet element via the piston rod.

2. The self-closing drawer guide of claim 1, wherein an end of the ratchet housing facing the piston rod is provided with an elongated extension which supports the cylindrical housing that receives the pretensioned spring.

3. The self-closing drawer guide of claim 2, wherein the ratchet housing and the extension that supports the cylindrical housing form an elongated integral component.

4. The self-closing drawer guide of claim 3, wherein the integral component is an integrated plastic component.

5. The self-closing drawer guide according to claim 1, further comprising a center rail supported for longitudinal movement relative to the running rail and the guide rail, said center rail supporting the running rail and the guide rail with a vertical mutual spacing therebetween, and wherein the ratchet housing and the spring assembly are arranged in an intermediate space between the running rail and the guide rail.

6. The self-closing drawer guide of guide 5, wherein the catch is arranged on the guide rail.

7. The self-closing drawer guide of claim 6, wherein the center rail is disposed between the guide rail and the running rail.

* * * * *

UNITED STATES PATENT AND TRADEMARK OFFICE

CERTIFICATE OF CORRECTION

PATENT NO. : 7,108,339 B2
APPLICATION NO. : 10/509287
DATED : September 19, 2006
INVENTOR(S) : Berger It is certified that error appears in the above-identified patent and that said Letters Patent is hereby corrected as shown below:

Column 1, Line 62, "BRIEF SUMMARY OR THE INVENTION" should read -- BRIEF SUMMARY OF THE INVENTION --

Column 6, Line 14, "drawer guide of guide 5" should read -- drawer guide of claim 5 --

Signed and Sealed this

Ninth Day of January, 2007

JON W. DUDAS
*Director of the United States Patent and Trademark Office*